US006994143B2

(12) United States Patent
McCarty et al.

(10) Patent No.: US 6,994,143 B2
(45) Date of Patent: Feb. 7, 2006

(54) CHILD SAFETY BLIND

(75) Inventors: Michael J. McCarty, Rancho Santa Margarita, CA (US); Frank A. Gutierrez, Hawthorne, CA (US)

(73) Assignee: 3 Day Blinds, Inc., Anaheim, CA (US)

( * ) Notice: Subject to any disclaimer, the term of this patent is extended or adjusted under 35 U.S.C. 154(b) by 143 days.

(21) Appl. No.: 10/394,607

(22) Filed: Mar. 21, 2003

(65) Prior Publication Data

US 2004/0182523 A1 Sep. 23, 2004

(51) Int. Cl.
*E06B 9/30* (2006.01)

(52) U.S. Cl. ..... 160/168.1 R; 160/178.1 R; 160/178.2; 24/555; 24/557

(58) Field of Classification Search ..... 160/349.1, 160/349.2, 178.1, 178.2, 178.3, 173 R, 168.1 R, 160/172 R See application file for complete search history.

(56) References Cited

U.S. PATENT DOCUMENTS

| | | | | | |
|---|---|---|---|---|---|
| 2,884,052 | A | * | 4/1959 | Lando et al. | 160/168.1 R |
| 4,271,893 | A | | 6/1981 | McCluskey | |
| 5,158,127 | A | * | 10/1992 | Schumacher | 160/84.07 |
| 5,275,222 | A | | 1/1994 | Jelic | |
| 5,377,739 | A | | 1/1995 | Kirby | |
| 5,472,036 | A | | 12/1995 | Judkins | |
| 5,524,692 | A | | 6/1996 | John | |
| 5,553,653 | A | | 9/1996 | Rozon | |
| 5,655,590 | A | * | 8/1997 | Bryant | 160/168.1 R |
| 5,671,793 | A | | 9/1997 | Lee | |
| 5,709,258 | A | | 1/1998 | Coccoluto | |
| 5,725,040 | A | | 3/1998 | Domel | |
| 5,743,319 | A | | 4/1998 | Christopherson | |
| 5,791,580 | A | | 8/1998 | Anderson | |
| 5,906,232 | A | | 5/1999 | Bauer | |
| 5,908,063 | A | | 6/1999 | Gobidas | |
| 5,971,054 | A | | 10/1999 | Gobidas | |
| 5,996,668 | A | | 12/1999 | DeBlock | |
| 6,009,931 | A | | 1/2000 | Peterson | |
| 6,186,214 | B1 | | 2/2001 | Ladd | |
| 6,189,595 | B1 | | 2/2001 | Lee | |
| 6,318,441 | B1 | | 11/2001 | Love | |
| 6,405,783 | B1 | | 6/2002 | Smith | |
| 6,431,246 | B1 | | 8/2002 | Peterson | |
| 6,431,248 | B1 | | 8/2002 | Hyman | |
| 6,463,987 | B1 | | 10/2002 | Nevins | |
| 6,557,615 | B2 | | 5/2003 | Smith | |

* cited by examiner

*Primary Examiner*—Blair M Johnson
(74) *Attorney, Agent, or Firm*—Rutan & Tucker, LLP

(57) ABSTRACT

A child safety blind having a head rail, a bottom rail, at least one ladder tape, a plurality of slats, a tilt wand and a pair of registry clips. At least one ladder tape extends horizontally between the head rail and the bottom rail, and the ladder tape comprising a plurality of steps. The slats extend horizontally between the head rail and the bottom rail, and each of the slats extends through one corresponding step of the ladder tape. The tilt wand is linked with ladder tape and operative to operative to drive the steps of the ladder tape to turn the slats with an angle. The pair of registry clips is operative to lift the bottom rail and the slats at two side portions thereof while holding the bottom rail and the slats therein.

5 Claims, 5 Drawing Sheets

Fig. 3
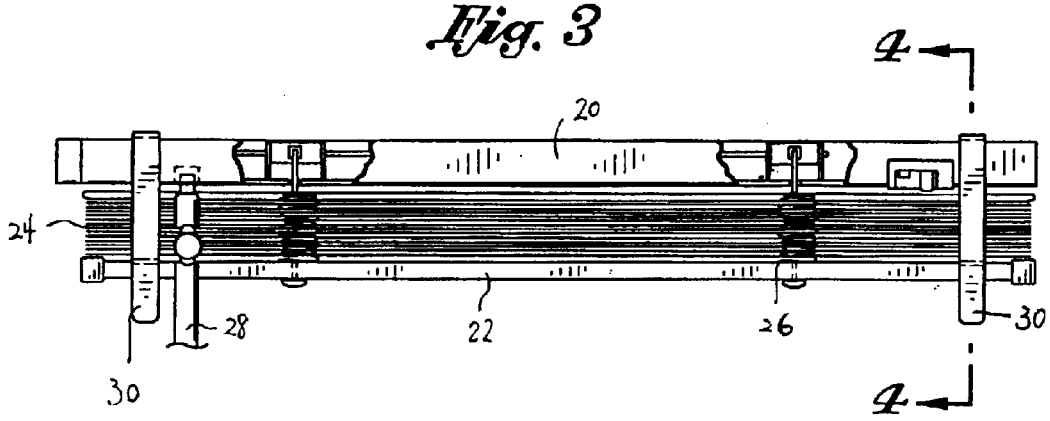
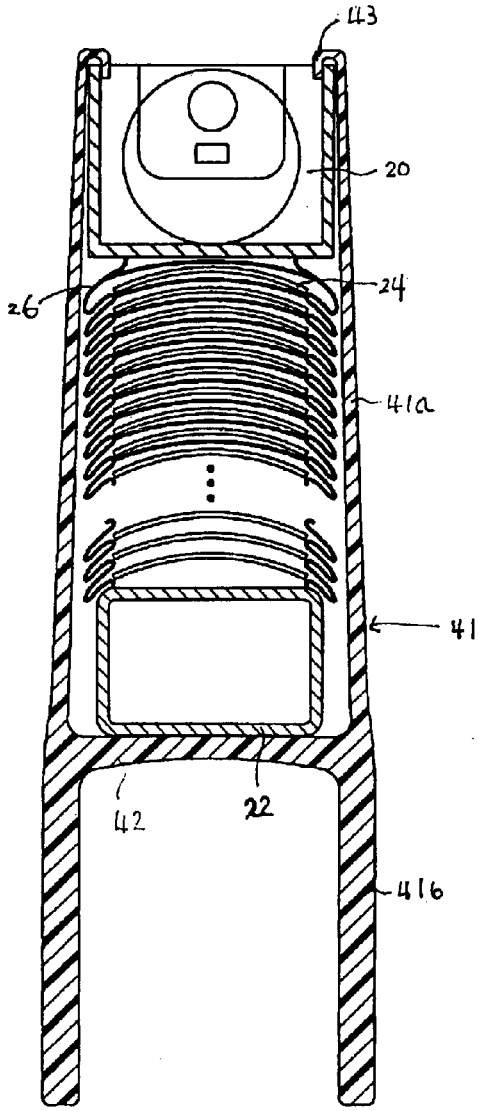
Fig. 4

CHILD SAFETY BLIND

CROSS-REFERENCE TO RELATED APPLICATIONS

Not Applicable

STATEMENT RE: FEDERALLY SPONSORED RESEARCH/DEVELOPMENT

Not Applicable

BACKGROUND OF THE INVENTION

The present invention relates in general to a window blind and, more particularly, to a child safety blind which can be raised or lowered without using a conventional lift or draw cord.

Blinds have been widely used to prevent sunlight from entering an area and to retain privacy. Typically, blinds include a plurality of slats, vanes or fabric pleats hung horizontally from a head rail.

FIG. 1 shows a conventional prior art horizontal blind. The blind comprises a head rail 10, a bottom rail 12, a plurality of slats 14 disposed between the head rail 10 and the bottom rail 12, a tilt rod or tilt wand 16, a pair of ladder tapes 18 driven by the tilt rod 16, a pair of lift cords 20 extending through the slats 14 from the bottom rail 12 to the head rail 10, and a lift cord 22 of the lift cords 20 external to the slats 14. As shown in FIG. 1, the slats 14 extend horizontally between the head rail 10 and the bottom rail 12. By turning the tilt rod/wand 12, the ladder tapes 18 are driven to adjust the orientation of each slat 14. The lift cord 22 normally comprises two strings extending through the slats 14 from the bottom rail to the head rail 10 and then through the head rail to a level accessible to the user to raise or lower the slats 14.

When the blind is disposed in its normal extended, operable, i.e., released, position, most of the lift cords 22 is out of reach for small children. However, when the blind is partly raised as shown in FIG. 1, or raised to a fully open position, the lift cords 22 extend downwardly and become readily accessible to small children, thereby posing a possible safety hazard to small children.

Recently, various accidental cord deaths to small children have been reported which has caused manufacturers to investigate and attempt to provide increased child safety devices. For example, some manufactures provide cord cleats to wrap excessively long cords as well as provide consumer warning labels on blind products. However, most of the cleats require special tools or procedures, including drilling and screwing to mount the same as well as require the user to always manually wind the cord about the cleat. As such, the prior art cleats are prone to be unreliable in preventing cord deaths.

BRIEF SUMMARY OF THE INVENTION

The present invention provides a child safety blind and method of retrofitting prior art blinds to provide improved child safety. The child safety blind comprises a head rail, a bottom rail, at least one ladder tape extending vertically between the head rail and the bottom rail, a plurality of slats horizontally extending between the head rail and the bottom rail, and a pair of registry clips. The ladder tape comprises a plurality of steps, allowing the slats to extend therethrough. The slats are thus supported by the respective steps. To lift the blind to an open position, a pair of registry clips may be used which are pressed open and positioned below the bottom rail to dispose the bottom rail and the slats therein. By manually raising the registry clips toward the head rail, the bottom rail and the slats are registered therewithin and raised to an open position. When the bottom rail and the slats are raised to a desired elevated position, preferably a fully open position, the registry clips can be released whereby the bottom rail and the slats are secured with the head rail by the registry clips.

In one embodiment, the registry clips comprise a spring clip having a pair of inwardly biased elongate members having a resilient connecting member connecting the elongate members together. The elongate members extend below the connecting member forming a pair of handles while the upper portion of the members form a pair of clip ends. Preferably, the registry clips further include a hook at the clip end of each member designed to preferably engage or hook over the top edge of the head rail or valence of the blind.

Alternatively, when the bottom rail and the slats are raised to an elevated position, a pair of tether straps can be used to wrap and releasably secure the bottom rail and the slats to the head rail. Various means can be used to attach the tether strap which wraps the bottom rail and the slats therein to the head rail or valence. For example, a hook may be installed at the front panel of the head rail and a loop may be attached to one end of the strap. Alternatively, the other end of the strap may include a magnetic material, and a magnet may be mounted to the rear panel of the head rail. In this manner, one end of strap is hooked at the front panel of the head rail, while the other end of the strap is attached to the rear panel thereof by a magnetic force. In addition, conventional hook and loop fasteners and other attaching mechanism can be used to engage one end of the strap with one panel of the head rail.

The present invention further provides a child safety blind converted from a prior art blind. The prior art blind comprises a head rail, a bottom rail, a plurality of slats, at least one ladder tape, a tilt wand, and a lift cord. The slats extend horizontally between the head rail and the bottom rail. The ladder tape extending vertically from the head rail to the bottom rail comprises a plurality of steps holding the slats passing therethrough. The lift cord extends from the bottom rail through each of the slats and the head rail.

When the prior art blind is installed to cover a desired area such as a window, the lift cord is cut and removed from the blind. Therefore, the child safety blind does not utilize any cord external to the blind or accessible to the user or children. The child safety blind may further comprise at least one registry clip operative to register and raise the bottom rail and the slats towards the head rail. The registry clip is also operative to releasably secure the bottom rail and the slats with the head rail and/or valence when the bottom rail and the slat are raised to a predetermined height. One end of the registry clip preferably includes a pair of hooks engageable to top edge of the head rail. The child safety blind further may comprise a holding means to secure the bottom rail and the slats raised at the predetermined height with the head rail. The holding means may comprise a tether strap with one end attached to one panel of the head rail by an attaching means and the other end engageable to the other panel of the head rail by an engaging means.

The present invention further provides a method of retrofitting conventional prior art blinds to become a child safety blind. In the retrofitting method, the lift cord or cords of the prior art blind is cut and removed from the blind.

Before the cutting step, the blind is preferably lowered to a fully extended, i.e. closed, position. After the lift cord is removed from the blind, the slats are solely supported by the ladder tapes. To raise the blind to an open position, a pair of registry clips is preferably used to receive and register the bottom rail and the slats therein, and to manually raise the bottom rail and the slats towards the head rail. To avoid the slats sliding out laterally, the pair of the registry clips are used simultaneously and preferably maintained at the same horizontal level during the raising process. The slats and the bottom rail may then be maintained in an open position by releasing the registry clips to engage the head rail or valence of the blind. Further, to subsequently release the slats to a closed or extended position, the registry clips are disengaged from the head rail and gradually lowered until the blind is fully extended. Again, the pair of the registry clips, plus the gradual lowering process, prevents the slats from laterally sliding out of the support ladder tapes.

As the child safety blind provided by the present invention does not include a lift cord, accidental strangulation is effectively prevented.

BRIEF DESCRIPTION OF THE DRAWINGS

These, as well as other features of the present invention, will become apparent upon reference to the drawings wherein:

FIG. 3 shows the child safety blind as illustrated in FIG. 2 in a completely open position;

FIG. 4 shows a cross sectional view along the line 4—4 of FIG. 3;

DETAILED DESCRIPTION OF THE INVENTION

Figure 2:
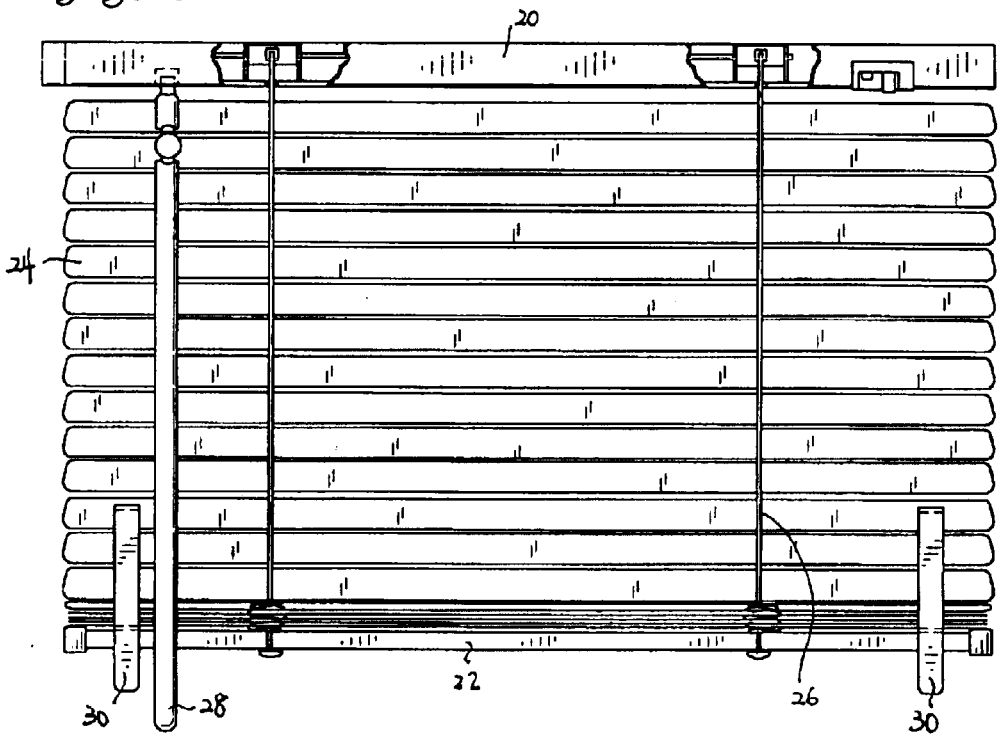
FIG. 2 shows a child safety blind according to one embodiment of the present invention.

The present invention provides a child safety blind which can be raised to a fully open position or lowered to an extended or closed position without using the lift cord used in a conventional blind. The child safety blind is applicable to all types of horizontal blinds such as wood blinds, faux wood blinds, bamboo blinds, mini blinds, metallic blinds, fabric cell blinds, and vinyl blinds and for purposes of this application, the term blind shall include all of the same. FIG. 2 depicts one embodiment of the child safety blind provided by the present invention. As shown in FIG. 2, the child safety blind comprises a head rail 20, a bottom rail 22, and a plurality of slats 24 horizontally extending between the head rail 20 and the bottom rail 22. The child safety blind further comprises a pair of ladder tapes 26. Each of the ladder tapes 26 comprises a plurality of steps or loops, and each slat 24 extends through a pair of corresponding steps of the ladder tapes 26. The blind also preferably includes a tilt wand 28 linked with the ladder tapes 26. By turning the tilt wand 28 clockwise or counterclockwise, the steps of each ladder tape 26 are adjusted; and consequently, the slat 24 extending through the steps are oriented with an angle between 0° and +180° in relation to an elongate direction of the blind. The tilt wand 28 is accessible to the user, thus allowing the user to adjust the desired angle of the slats 24.

Figure 5:
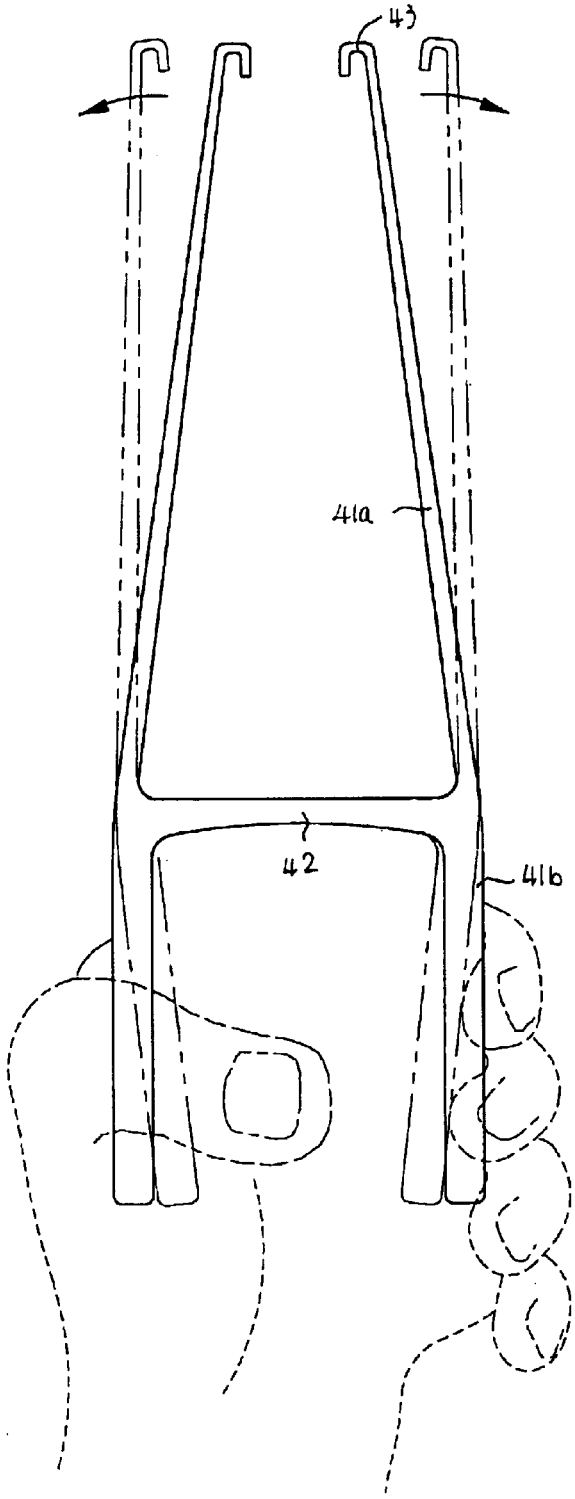
FIG. 5 shows a side view of a clip for raising the slats of the child safety blind.
Figure 6:
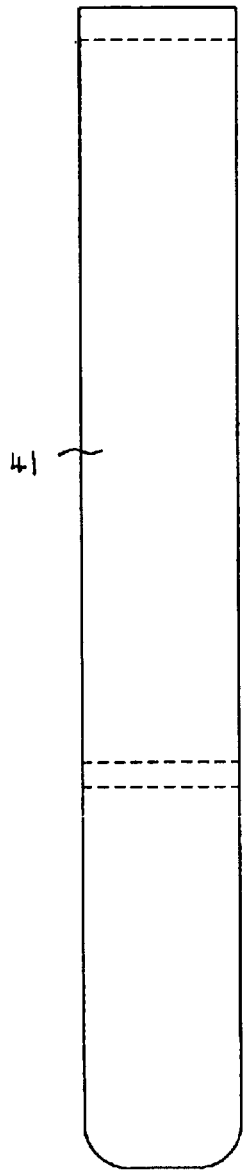
FIG. 6 shows a front view of the clip as illustrated in FIG. 5.
Figure 7:
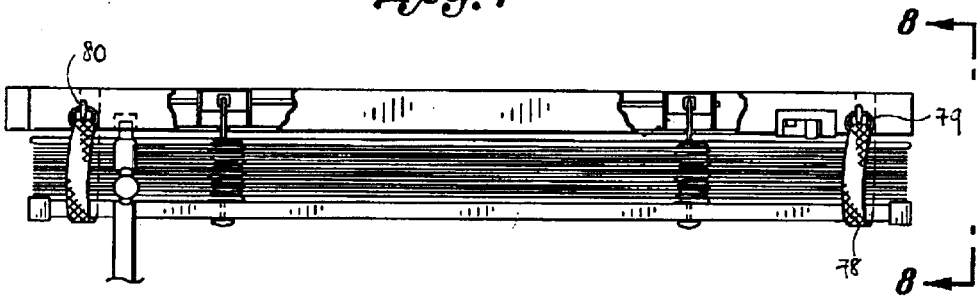
FIG. 7 shows another embodiment in which the blind is held in the fully open position by another mechanism other than the clip as shown in FIGS. 3–6.

As shown in FIG. 2, the child safety blind does not include a conventional lift cord used to raise and lower the bottom rail and slats toward the head rail in a conventional blind. Although it is contemplated that the bottom rail and the slats could be manually grasped by hands of a user and be raised upwardly to an open position, to facilitate the lift or retract function, the child safety blind preferably utilizes a pair of registry clips 30. In one embodiment as shown in FIGS. 4 to 6, each of the registry clips 30 comprises a spring clip having a pair of elongate members 41 and a resilient connecting member 42 connecting the resilient members 41 together. Each of the members 41 has a pair of clip ends 41*a* formed above the connecting member 42, and a pair of handles 41*b* disposed below the connecting member 42 sized to be grasped by user. In the preferred embodiment, the registry clips 30 are molded from a polymer material having sufficient internal resiliency to bias the clip ends 41*a* toward one another. However, those skilled in the art will recognize that alternative spring clip constructions are contemplated herein.

As shown in FIG. 2, to use the registry clips 30 to lift the child safety blind, the user grasps the handles 41*b* of the pair of registry clips 30 in two hands and disposes the registry clips 30 under two side portions of the bottom rail 22 of the blind. As shown in FIG. 5, by pressing the handles 41*b* inwardly toward each other, the clip ends 41*a* are forced open to a distance larger than the thickness of the bottom rail 22 and the slats 24. During manual lifting of the clips 30, the bottom rail 22 and the slats 24 are being funneled and vertically registered into the registry clips 30 as shown in FIG. 2. To avoid the slats 24 sliding out laterally, the registry clips 30 are kept substantially level to each other while raising the bottom rail 22 and the slats 24 towards the head rail 20. By gradually raising the pair of registry clips, the blind is retracted to a fully open position as shown in FIG. 3. When the blind is raised to a fully open position, the registry clips 30 clip may be manually released to releasably attach the clips 30 and bottom rail and slat to the head rail 20 to hold the blind in this open position. As shown in FIG. 3, as the bottom rail 22, the slats 24 and the head rail 20 are all held within the registry clip 30 at the fully open position, the length of the registry clips 30 is larger then the total length of the blind while being retracted. Preferably, the length of the clip ends 41*a* of the registry clips 30 is slightly larger than the total length of the bottom rail 22, the slats 24 and the head rail 20 of the blind along the line 4—4, while the width and length of the registry clips 30 is so configured to allow the user to grasp and press conveniently.

To lower the blind down to an extended position, the handles 41*b* are manually pressed against each other, such that the clip members 41*a* are force open again. When the registry clips 30 are hooked at the head rail as shown in FIG. 4, the registry clips 30 are raised upward slightly and the handles 41*b* are pressed to release the hooks 43 from the head rail 20. The registry clips 30 held in two hands of the user are then gradually lowered, such that the slats 24 are gradually released from the registry clips 30. Again, to avoid the slats 24 sliding out laterally, the pair of registry clips 30 is lowered simultaneously and generally level to each other until the blind reaches a fully open position. Further, in the process of lowering the blind, the handles 41*b* of the registry clips 30 are continuously pressed inwardly allowing the slats 24 to be released therefrom. When the blind is extended, the registry clips 30 can be removed from the blind and kept in a convenient and safe area.

It will be appreciated that the exemplary registry clips 30 as described above and shown in FIG. 4 to FIG. 6 are only examples of the present invention. Other structure operative to register and raise the bottom rail 22 and the slats 24 towards the head rail 20 can also be applied to the present invention. For example, the registry clips 30 may comprise two elongate clip members, a pivot pin connecting the clip members to each other, and a resilient member providing the clipping function of the clip members.

Figure 8:
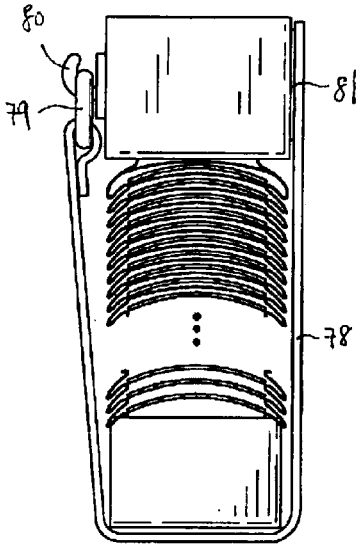
FIG. 8 shows another mechanism for holding the blind in the fully open position.
Figure 9:
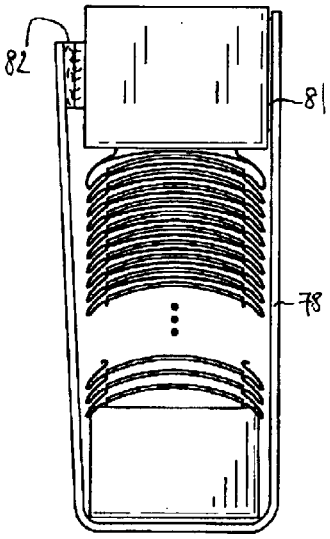
FIG. 9 shows another mechanism for holding the blind in the fully open position.
Figure 10:
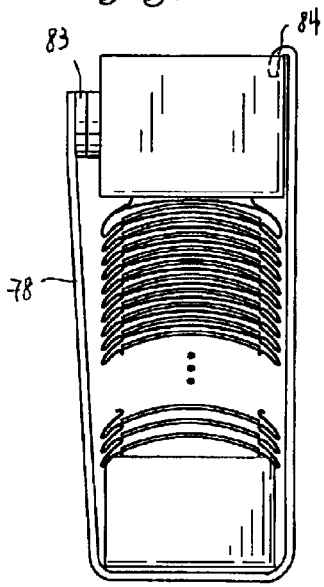
FIG. 10 shows yet another mechanism for holding the blind in the fully open position.

In addition to the registry clips 30, other mechanisms can also be used to secure the blind in the fully open or partially open position. FIG. 8 to FIG. 10 shows various embodiments of the securing mechanisms. In FIG. 8, when the bottom rail 22 and the slats 24 are lifted to an open position, a strap 78 is used to secure the blind in the open position. The strap 78 has one end connected with a loop 79 and the other end attached to one side (rear panel) of the head rail 20. As shown in FIG. 8, a hook 80 is mounted on the other side (front panel) of the head rail 20. Therefore, by wrapping the bottom rail 22 and the slats 24 from the rear panel to the front panel of the head rail 20 with the strap 78 and engaging the loop 79 with the hook 80, the bottom rail 22 and the slats 24 are secured by the strap 78 in the open position. The blind can be easily released to the close position simply by disengaging or removing the loop 79 from the hook 80.

FIG. 9 shows a side view along the line 8—8 of FIG. 8. As shown in FIG. 8, one end of the strap 78 can be made of magnetic material, while a magnet 81 is attached to the rear side of the head rail 20 can be used the rear side of the head rail 20. Therefore, one end of the strap 78 can be attached to the rear side of the head rail 20 by the magnet 81. In addition to the loop 79 and hook 80 and magnet 81, other connectors can also be used to connect two ends of the strap 80 to the head rail 20. As shown in FIG. 9, the loop 79 and the hook 80 are replaced by a pair of Velcro® brand hook and loop fasteners attached to the front side of the head rail 20 and one end of the strap 78. In FIG. 9, again, the other side of the strap 78 is attached to the rear side of the head rail 20 via magnet 81. In FIG. 10, a magnet 82 is attached to one end of the strap 80 and the front side of the head rail 20, while the other end of the strap 80 terminates with a hook 83 to engage a top edge of the rear side of the head rail 20.

As the lift cord is completely removed from the blind, the possibility of accidental cord death is substantially eliminated. Further, without the extension of the lift cords hanging in front of the blind, a more decorative effect is obtained. As the registry clips 30 and/or the straps 80 are not permanently mounted to the blind, the tools, including the registry clips 30 and the straps 80 can be removed from the blind and kept in the drawer or other safe area. Neither the registry clips 30 nor the straps 80 will provide the adverse aesthetic effect. On the contrary, various patterns and colors can be designed on the registry clips 30 and the straps 80 to match with the interior design of the room. Therefore, the blind provided by the present invention does not only provide a safe environment to the children, but also provide a positive decorative effect of the environment.

Figure 1:
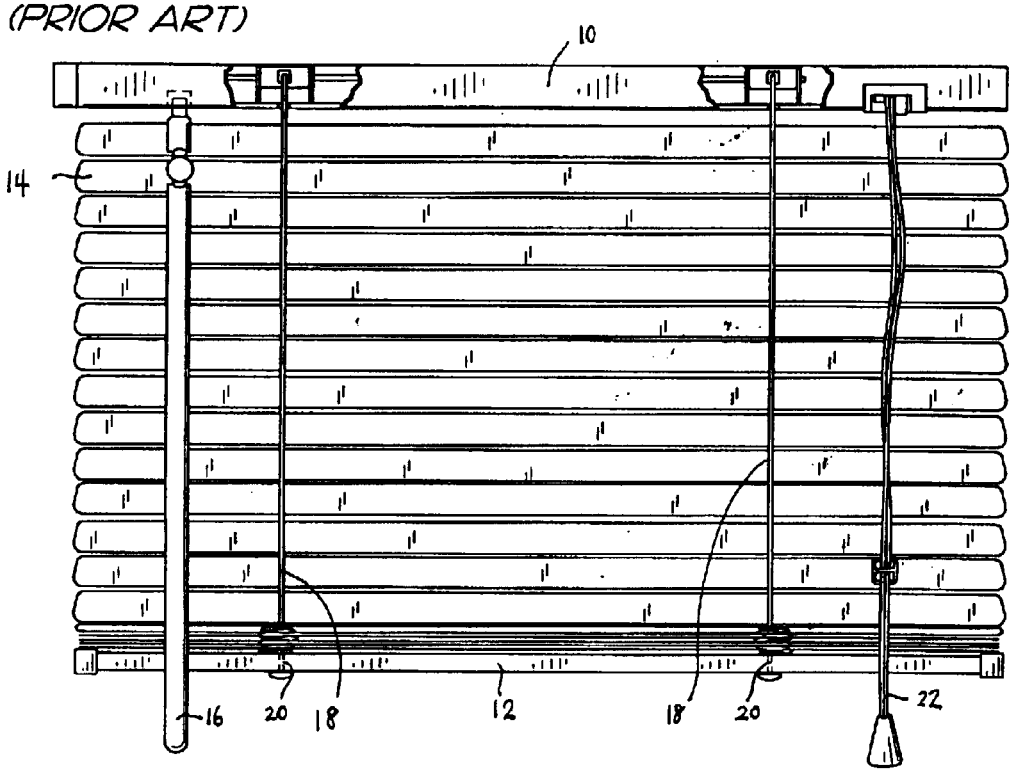
Fig. 1 (PRIOR ART)
FIG. 1 shows a conventional horizontal blind.
Figure 11:
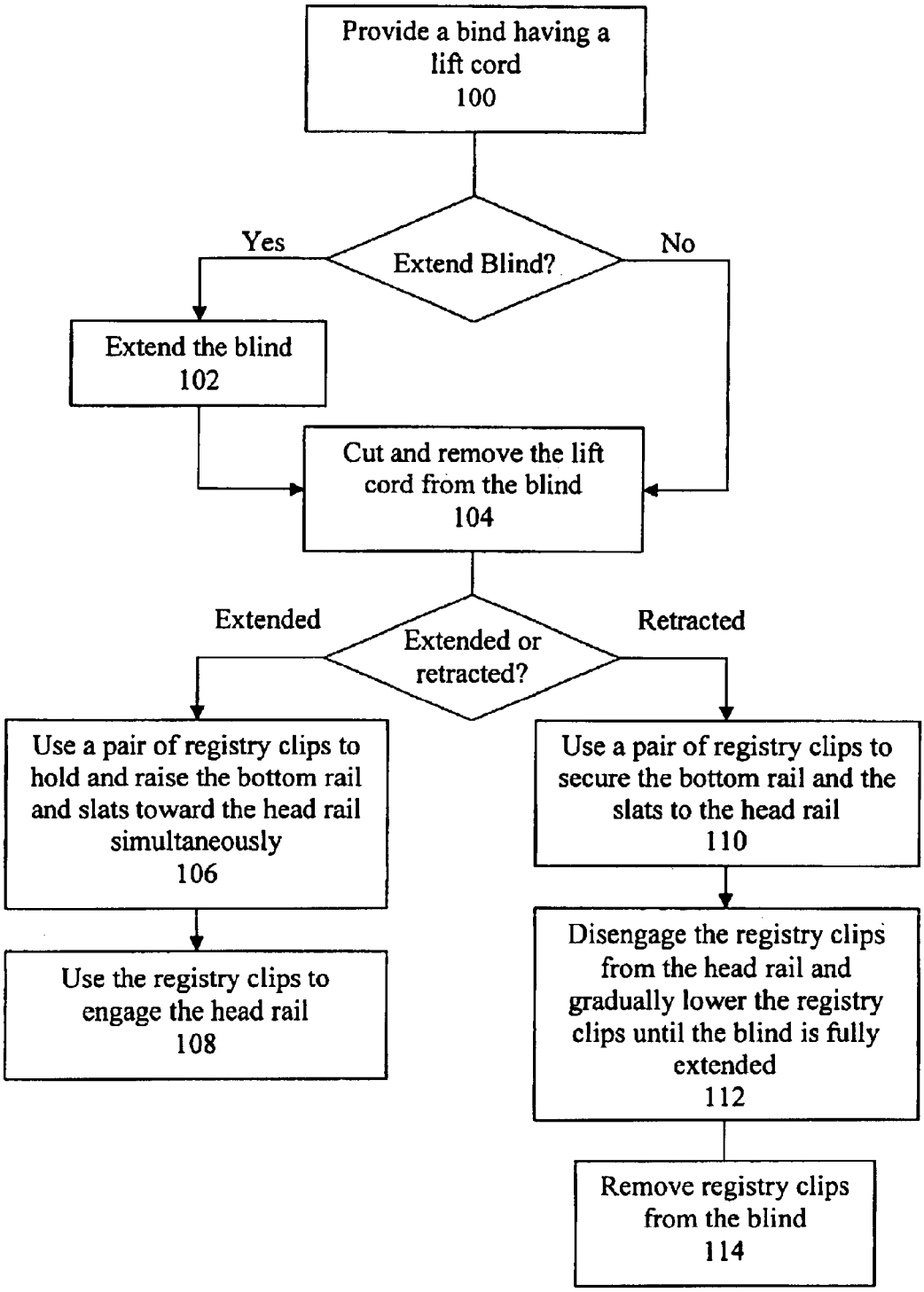
FIG. 11 shows a respective fitting method of a child safety blind.

According to the above, the present invention further provides a retrofitting method, such that the conventional blind can be modified into a child safety blind. The method comprises several process steps as shown in FIG. 11. In step 100, a conventional blind including a head rail, a bottom rail, a plurality of slats between the head and bottom rail, and at least one lift cord extending from the bottom rail through the slats and the head rail is provided. Preferably, the conventional blind further comprises at least one ladder tape extending between the head rail and the bottom rail. The slats are secured and supported by the lift cord to avoid sliding out from two laterally sides. Preferably, as shown in FIG. 1, the blind is lowered to a fully close position in step 102. In step 104, the lift cord is cut and removed from the blind, leaving the slats supported by ladder tape solely. As the lift cord has been removed from the blind, to retract the blind to an open position, a pair of registry clips as mentioned above may be used. In step 106, the pair of registry clips is held under two sides of the bottom rail, pressed open to receive the bottom rail and the slats, and gradually raised upwardly towards the head rail. When the bottom rail and the slats are lifted to the desired open position, the registry clips compress again and hook to the head rail to secure the open position of the blind in step 108. It is appreciated that to modify the conventional blind with a cord lift into the child safety blind, one can perform step 104 without extending the blind in step 102. In such condition, the blind is retracted when the lift cord is removed in step 104. Therefore, in step 110, a pair of registry clips with the structure mentioned above is used to secure the bottom rail and the slats to the head rail. When an extended position is required, the registry clips are disengaged from the head rail and gradually lowered until the blind is fully extended in step 112. The registry clips can then be removed from the blind and kept in a safe place in step 114. To avoid the slats sliding out during the raising or lowering processes in steps 106 and 112, the registry clips are preferably kept level to each other. In the above steps 108 and 110, other fastening means such as a strap can be used to secure the bottom rail and the slats to the head rail.

This disclosure provides exemplary embodiments of a child safety blind. The scope of this disclosure is not limited by these exemplary embodiments. Numerous variations, whether explicitly provided for by the specification or implied by the specification, such as variations in shape, structure, dimension, type of material or manufacturing process may be implemented by one of skill in the art in view of this disclosure.

What is claimed:

1. A child safety blind, comprising:

a head rail;

a bottom rail;

a plurality of slats extending horizontally between the head rail and the bottom rail, each of the slats extending through one corresponding step of a ladder tape; and at least one registry clip each registry clip comprises a pair of hooks to engage the head rail, each registry clip being with a handle adapted to be gripped by a user in order to register and lift the bottom rail and the slats while holding the bottom rail and the slats therein.

2. The child safety blind according to claim 1, wherein each registry clip comprises a pair of elongate members forming a clip end and a handle end, and a connecting member connecting the members together.

3. The child safety blind according to claim 1, wherein each registry clip is formed of a unitary polymer material.

4. The child safety blind according to claim 1, further comprising a tilt wand cooperating with the ladder tape to control orientation of the slats.

5. The child safety blind according to claim 1, wherein the registry clip is removable from the child safety blind.

* * * * *